United States Patent [19]

Lelental et al.

[11] 4,144,062

[45] Mar. 13, 1979

[54] ORGANOTELLURIUM (II) AND (IV) COMPOUNDS IN HEAT-DEVELOPABLE PHOTOGRAPHIC MATERIALS AND PROCESS

[75] Inventors: Mark Lelental, Penfield; Henry J. Gysling, Rochester, both of N.Y.

[73] Assignee: Eastman Kodak Company, Rochester, N.Y.

[21] Appl. No.: 848,062

[22] Filed: Nov. 3, 1977

Related U.S. Application Data

[63] Continuation-in-part of Ser. No. 703,477, Jul. 8, 1976, abandoned.

[51] Int. Cl.[2] ..... G03C 5/24; G03C 1/76; G03C 1/00; G03C 1/02

[52] U.S. Cl. ..... 96/114.1; 96/48 HD; 96/67; 96/88

[58] Field of Search ..... 96/114.1, 48, 48 PD, 96/48 HD, 67, 108, 109, 88, 66 T

[56] References Cited

U.S. PATENT DOCUMENTS

| | | | |
|---|---|---|---|
| 1,939,232 | 12/1933 | Sheppard et al. | 96/114.1 |
| 2,868,643 | 1/1959 | DeJonge et al. | 96/48 R |
| 3,130,052 | 4/1964 | Dippel et al. | 96/48 R |
| 3,152,904 | 10/1964 | Sorenson et al. | 96/48 PD |
| 3,223,525 | 12/1965 | Jonker et al. | 96/48 PD |
| 3,392,020 | 7/1968 | Yutzy et al. | 96/114.1 |
| 3,457,075 | 7/1969 | Morgan et al. | 96/114.1 |
| 3,650,748 | 3/1976 | Yudelson et al. | 96/48 PD |
| 3,700,448 | 10/1972 | Hillson | 96/48 PD |
| 3,708,304 | 1/1973 | Hiller | 96/114.1 |
| 3,874,946 | 4/1975 | Costa et al. | 96/114.1 |
| 4,066,460 | 1/1978 | Chang et al. | 96/48 HD |
| 4,076,537 | 2/1978 | Tsuboi | 96/48 HD |

FOREIGN PATENT DOCUMENTS

| | | | |
|---|---|---|---|
| 786235 | 7/1972 | Belgium | 96/114.1 |
| 2233868 | 2/1973 | Fed. Rep. of Germany | 96/48 R |
| 2504652 | 8/1975 | Fed. Rep. of Germany | 96/114.1 |
| 2522778 | 12/1974 | Fed. Rep. of Germany | 96/48 HD |
| 1161777 | 8/1969 | United Kingdom | 96/114.1 |
| 1405628 | 9/1975 | United Kingdom | 96/48 R |

*Primary Examiner*—Travis Brown
*Assistant Examiner*—L. Falasco
*Attorney, Agent, or Firm*—Richard E. Knapp

[57] ABSTRACT

A heat developable, photographic material comprising (a) a photographic metal compound with (b) an oxidation-reduction image-forming combination comprising (i) a tellurium (II) or (IV) compound as an oxidizing agent and (ii) a reducing agent provides an improved amplified image. The photographic metal compound can be, for example, photograhic silver halide. A developed image can be provided in the material after imagewise exposure by heating the element to moderately elevated temperatures.

31 Claims, No Drawings

ORGANOTELLURIUM (II) AND (IV) COMPOUNDS IN HEAT-DEVELOPABLE PHOTOGRAPHIC MATERIALS AND PROCESS

This is a continuation-in-part application of U.S. Patent application Ser. No. 703,477 of Mark Lelental and Henry J. Gysling, filed July 8, 1976 now abandoned.

BACKGROUND OF THE INVENTION

1. Field of the Invention

This invention relates to heat-developable photographic materials and processes for developing an image employing a photographic metal compound with an image-forming combination comprising (i) tellurium (II) or (IV) compound as an oxidizing agent with (ii) a reducing agent. In one of its aspects, it relates to a heat-developable photographic element comprising an oxidation-reduction image-forming combination as described. Another aspect of the invention relates to a heat-developable, photographic composition comprising the described image-forming combination. A further aspect of the invention relates to a process of developing an image in a heat-developable photographic element comprising tellurium (II) or (IV) compound as described.

2. Description of the State of the Art

It is known to provide an image with an imaging material, especially a photographic imaging material by so-called dry processing with heat. These materials are sometimes described as heat-developable photographic materials or photothermographic materials. Such heat-developable photographic materials after imagewise exposure are heated to provide a developed image in the absence of processing solutions or baths.

It has been desirable to provide reduced silver concentrations in heat-developable imaging materials. Attempts have been made in the past to provide this desired reduced silver concentration. For example, U.S. Pat. No. 3,152,903 of Shepard et al., issued Oct. 13, 1964 describes a so-called dry-processable imaging material containing a non-silver material. It is indicated that the image-forming composition can comprise a latent irreversible oxidation-reduction reaction composition which is capable of initiation by electron transfer from a non-silver photocatalyst. The photocatalyst can be, for example, zinc oxide or titanium dioxide. A disadvantage of the imaging material described in this patent is that the image formation is not carried out using amplification as in most heat-developable silver photographic materials. This provides the necessity for undesirably high concentrations of non-silver materials. It has been desirable to overcome this problem by providing a more effective non-silver heat-developable material, that is a material which enables desired latent image amplification.

An amplification step is an important factor in increased speed photographic materials. In such processes and materials, a catalyst is generally formed by imagewise exposure of a photosensitive material. The resulting invisible or latent image formed is then used to catalyze the reduction of a material in a high oxidation state to a visible image in a low oxidation state. In silver halide photographic materials, for example, exposure of photographic silver halide to light results in formation of silver nuclei which then catalyze the further reduction of silver halide to silver in the presence of a reducing agent.

It has also been known to produce tellurium images by disproportionation of tellurium dihalides. The images are formed in the presence of the processing liquid which helps in the disproportionation. Some unexposed tellurium dihalides, however, are dark in color causing poor image discrimination. Further, the tellurium dihalides are typically unstable in air and undergo light-induced decomposition only when moistened with an organic solvent. Accordingly, the tellurium dihalides would be expected to be disadvantageous in imaging materials designed for dry processing.

It is also known that certain tellurium (IV) compounds wherein the tellurium is bonded directly to a carbon atom can be used in imaging. In Belgian Pat. No. 786,235 issued July 31, 1972, corresponding to U.K. Pat. No. 1,405,628, certain tellurium compounds wherein the tellurium is bonded directly to a carbon atom are indicated as useful in image-forming materials. The materials and process described are materials which undergo a so-called unit quantum photoreduction to yield a tellurium image. This material and process are not catalytic, that is, the tellurium (O) formed upon exposure does not catalyze the decomposition or other reaction of the tellurium (IV) compound. The process and material are, therefore, inherently photographically slow in speed and limited in usefulness.

Imaging materials have also been described wherein a substance capable of darkening when heated is heated in the presence of a catalyst such as described in U.S. Pat. No. 1,939,232 of Shepard et al issued Dec. 12, 1933. This imaging material does not involve a heat-developable photographic material comprising an organotellurium compound. Rather, it involves a combination of, for example, silver oxalate and a catalyst resulting from, for example, tellurium dichloride.

Materials are known in the imaging art in which metal nuclei are used for physical development purposes. None of these materials, however, involve nuclei in a heat-developable photographic material comprising tellurium (II) or (IV) compounds.

There has been a continuing need to provide improved tellurium containing heat-developable photographic elements, compositions and processes which enable reduced concentrations of silver in the described materials. This continuing need has been especially true for non-silver heat-developable materials which enable amplification of a nuclei image without the need for use of processing solutions.

SUMMARY OF THE INVENTION

It has been found according to the invention that an image can be provided in a heat-developable photographic material comprising in reactive association (a) a photographic metal salt, such as photographic silver halide, (b) an oxidation-reduction image-forming combination comprising: (i) a tellurium (II) or (IV) compound as an oxidizing agent, especially such a tellurium compound which is selected from coordination complexes and organotellurium derivatives of tellurium (II) and (IV), and (ii) a reducing agent, and (c) a binder.

A visible image in the described heat-developable materials can be provided by merely heating the material to moderately elevated temperatures to provide a developed image in the absence of processing solutions or baths.

An important advantage of the described heat-developable materials is that they enable an amplification factor which is significantly higher than was enabled by prior heat-developable non-silver materials based on tellurium complexes. For example, an image amplification factor of at least $10^6$ is obtained in the described heat-developable materials. This is due in part to the fact that the described nuclei, especially the silver nuclei from photographic silver halide, enable a catalytic amplification of the latent image.

DETAILED DESCRIPTION OF THE INVENTION

An important embodiment of the invention is described is a heat-developable, photographic element comprising a support having thereon in reactive association (a) a photographic metal salt, (b) an oxidation-reduction image-forming combination comprising (i) a tellurium (II) or (IV) compound as an oxidizing agent, and (ii) a reducing agent, and (c) a binder. A range of tellurium (II) and (IV) compounds are useful in the described materials as oxidizing agents. Selection of an optimum tellurium (II) or (IV) compound will depend upon such factors as processing conditions, desired image, other components of the imaging material and the like. Especially useful tellurium (II) or (IV) compounds are coordination complexes of tellurium (II) or (IV), typically coordination complexes of tellurium (II) with two univalent bidentate sulfur-containing ligands. The described complexes of tellurium (II) have a coordination number of four. The complexes are characterized by having at least one of the coordinating ligands coordinate to the tellurium through a sulfur atom. However, complexes as described may have any number of tellurium (II) coordination positions occupied by the sulfur atom of a suitable sulfur-containing ligand. The tellurium (II) can be coordinated with a monodentate, bidentate or tridentate sulfur-containing ligand or with combinations of these ligands. The tellurium (II) can also be coordinated with a tetradentate sulfur ligand. The sulfur-containing ligands can be either neutral or anionic.

Useful monodentate sulfur ligands include neutral Lewis base ligands such as thiourea; substituted thiourea, such as ethylene thiourea, N,N'-diphenyl thiourea, 1-(1-naphthyl)-2-thiourea, tetramethyl-2-thiourea; 1-methyl-2-thiourea; 1-butyl-2-thiourea; and the like.

Useful bidentate sulfur ligands include anionic bidentate ligands such as dithiocarbamates represented by the formula

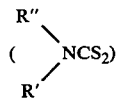

wherein R' and R'' are each hydrogen, aryl, such as phenyl, benzyl, alkyl containing 1 to 6 carbon atoms, including methyl, ethyl, propyl, isopropyl, cyclohexyl or heterocyclic, such as a 5 or 6 member heterocyclic group including, for example, N-furfuryldithiocarbamate and the like with at least one of R' and R'' being aryl, alkyl or heterocyclic or R' and R'' can together represent the atoms, especially the carbon and oxygen atoms, necessary to complete a five- or six-membered heterocyclic ring with the noted nitrogen atom in $NCS_2$, such as pentamethylenedithiocarbamate, pyrrolidinodithiocarbamate, and morpholinodithiocarbamate; xanthates represented by the formula ($R^2OCS_2$) wherein $R^2$ is alkyl containing 1 to 20 carbon atoms, such as methyl, ethyl, propyl, isopropyl, cyclohexyl and the like; dithiophosphates represented by the formula ($(R^2O)_2PS_2$); dithiophosphinates represented by the formula ($R^2{}_2PS_2$); dithiocarboxylates such as those represented by the formula ($R^3CS_2$) wherein $R^3$ is aryl, such as phenyl, naphthyl and substituted phenyl and naphthyl; dithioalkanes represented by the formula $R^4$—S—$(CH_2)$—$_n$S—$R^5$ wherein n is an integer from 1 to 6 and $R^4$ and $R^5$ are the same or different and are aryl such as phenyl, naphthyl, substituted phenyl and the like. Other useful bidentate ligands are described in the reference: D. Coucouvanis, *Prog. Inorganic Chemistry,* Volume 11, page 233 (1970).

Suitable tridentate sulfur-containing ligands include trithioalkanes represented by the formula $R^4$—S—$(CH_2)$—$_n$S—$(CH_2)$—$_n$S—$R^5$ wherein $R^4$, $R^5$ and n are as defined.

Useful tetradentate sulfur ligands include tetrathioalkanes represented by the formula $R^4$—S—$(CH_2)$—$_n$S—$(CH_2)$—$_n$S—$(CH_2)$—$_n$S—$R^5$ wherein $R^4$, $R^5$ and n are as defined. Macrocyclic ligands are also useful, such as the macrocyclic ligands described in the reference: K. Travis and D. H. Busch, *Inorganic Chemistry,* Vol. 13, beginning at page 2591 (1974).

Provided that at least one of the coordination positions of the tellurium (II) complex is occupied by a sulfur-containing ligand as described, the remaining positions, if any, can be occupied by either neutral or anionic ligands. Depending upon the combination of sulfur-containing ligands, neutral ligands and anionic ligands, the tellurium complex may have a valence, which is intended to mean a charge on the complex, of from 0 to 2. In instances in which a complex has a valence other than 0, a neutral salt of the complex can also be useful. In instances in which the complex itself is neutral, it can be used alone.

The term organotellurium (II) or (IV) "compound" and the term "complex" as used herein are intended to include any type of bonding or complexing mechanism which enables the resulting material to provide oxidizing agent properties and the described oxidation-reduction image-forming combination. In some instances the exact bonding of the described tellurium (II) and (IV) compounds is not fully understood. Accordingly, the terms "compound" and "complex" are intended to include salts and other forms of bonding which enable the desired oxidation-reduction image-forming combination. The terms organotellurium "compound" and "complex", as described, also are intended to include neutral complexes or salts of non-neutral complexes.

A wide variety of ligands known in the art can be useful. Typical neutral ligands useful herein are within the group Va or VIa donor atoms. Examples of these ligands are $P(C_6H_5)_3$; 1,10-phenanthroline; 2,2'-bipyridine and the like. Typical anionic ligands include halides such as chloro, bromo and iodo; ions which function like halides such as (NCO), (NCS), (NCSe), (NCTe) and the like; cyanoborohydride (i.e., $BH_3CN$); hydroborate anions such as ($BH_4$), ($B_3H_8$), ($B_9H_{14}$) and the like; carboxylates such as ($CH_3CO_2$), ($CF_3CO_2$) and the like; ($NO_2$); ($NO_3$); ($SO_4$); ($BF_4$); $B(C_6H_5)_4$; ($ClO_4$); ($PF_6$) and the like.

While a wide variety of organotellurium (II) or (IV) compounds or coordination complexes of tellurium (II) or (IV) are useful in the imaging materials as described, an especially useful group includes compounds or complexes wherein the tellurium (II) is complexed with two univalent bidentate sulfur-containing ligands.

The organotellurium (II) compound can be prepared by substitution reactions starting with a suitable inorganic tellurium (II) compound such as sodium tellurium thiosulfate and the like. The inorganic compound can be dissolved in a warm acid, such as hydrochloric or hydrobromic acid, and a warm aqueous solution of an alkali metal or ammonium salt of the desired bidentate anionic ligand is added. The desired organotellurium compound readily precipitates and can be recovered using separation methods known in the art.

Organotellurium compounds or complexes wherein the tellurium (II) is complexed with two bidentate sulfur-containing ligands are represented by the formula: $[Te(BL^1)(BL^2)]$ wherein $BL^1$ and $BL^2$ are the same or different and represent bidentate sulfur-containing ligands as described. Typical organotellurium (II) compounds which are useful include, for example:

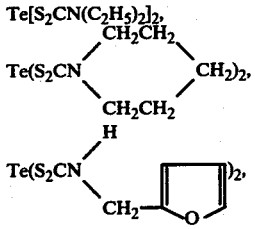

$Te[S_2CN(C_2H_5)_2]_2$,
$Te(S_2COCH_3)_2$,
$Te(S_2COC_2H_5)_2$,
$Te[S_2P(C_6H_{11})_2]_2$,
$Te(S_2COC_{10}H_{21})_2$,
$Te(S_2COC_6H_{13})_2$,
$Te(S_2COC_5H_{11})_2$,
$Te[S_2COCH(CH_3)_2]_2$, and
$Te(S_2COC_{18}H_{37})_2$.

Another useful group of organotellurium compounds includes compounds wherein the tellurium (II) is complexed with two monodentate ligands which are neutral Lewis bases and contain sulfur donor atoms and with two ligands which are univalent anionic ligands. These compounds or complexes can be prepared by methods known in the art such as by ligand reduction of an organotellurium (IV) compound using the appropriate sulfur ligand as described. Organotellurium compounds of this group can be represented by the formula: $[Te(NML^1)(NML^2)(UAL^1)(UAL^2)]$ wherein $NML^1$ and $NML^2$ are the same or different and represent neutral Lewis base monodentate ligands containing sulfur donor atoms as described above; and $UAL^1$ and $UAL^2$ are the same or different and represent univalent anionic ligands also as described above. Typical organotellurium compounds within this group include, for example:

$[Te(thiourea)_2(Cl)_2]$,
$[Te(thiourea)_2(SCN)_2]$,
$[Te(1\text{-allyl-2-thiourea})_2(Cl)_2]$, and
$[Te(1,3\text{-diallyl-2-thiourea})_2(Cl)_2]$.

A third useful group of organotellurium compounds includes compounds wherein the tellurium (II) is coordinated to four monodentate ligands which are neutral Lewis bases and contain sulfur donor atoms. All four ligands can be the same; or there can be two of one ligand and two of another ligand coordinated with the tellurium (II). These compounds have a valence, which is intended to mean a charge on the compound, of +2 and form salts with common anions. These compounds can be prepared by the same methods as those for the second group described using a large excess of the desired sulfur ligand. Organotellurium compounds of this third group can be represented by the formula:

$$[Te(NML^1)_2(NML^2)_2](UAL^1)(UAL^2)$$

wherein $NML^1$, $NML^2$, $UAL^1$ and $UAL^2$ are as described. Typical organotellurium compounds within this group include, for example:

$[Te(ethylenethiourea)_4]Cl_2$ and
$[Te(1\text{-}(1\text{-naphthyl})\text{-2-thiourea})_4]Cl_2$.

Organotellurium compounds of the described groups to be most useful should be relatively pale-colored or colorless and capable of forming images of good definition due to the lack of color. These organotellurium compounds can be combined with a suitable reducing agent to provide imaging materials which can thermally deposit tellurium metal under the influence of acceptable catalytic centers, for example, Te(O), Cu(O), Pd(O), Au(O) and/or Ag(O).

Complexes of tellurium or organotellurium compounds which are useful according to the invention are also described in copending U.S. Patent application Ser. No. 703,405 of Gysling, filed July 8, 1976 now abandoned.

Coordination complexes of tellurium (IV), as described, are useful oxidizing agents in the imaging elements according to the invention. Examples of suitable tellurium (IV) coordination complexes include penta and hexahalo, such as chloro, bromo and iodo, complexes, including $[TeX_5]^{1-}$ and $[TeX_6]^{2-}$, wherein X is chlorine, bromine or iodine, and various mixed complexes, such as $[TeCl_4Br]^{2-}$ and the like. The counter cation of such anionic complexes can be an alkali or alkaline earth metal ion, a quaternary ammonium ion, $[N(P(C_6H_5)_3)_2]^+$ and other organometallic cations that do not adversely affect the desired imaging. Such halo complexes are described, for instance, in G. A. Ozin and A. Vander Voet, J. Mol. Struct., 13, 435 (1972); B. Krebs and V. Paulat, Agnew. Chem. (Internat. Ed.), 12, 666 (1973); and I. R. Beattie and H. Chudzynska, J. Chem. Soc. (A), 984 (1967), and in Tellurium, W. C. Cooper, editor, Van Nostrand Reinhold Co., N.Y., N.Y., 1971, pages 135–148. Other tellurium (IV) coordination complexes include those represented by the formula: $TeX_4 \cdot 2L$, wherein X is chlorine, bromine or iodine, and L is a neutral ligand with a group Va or VIa donor atom. Examples of such complexes are $TeCl_4.2(C_6H_5N(CH_3)_2)$; $TeCl_2.2$ pyridine; $TeCl_4(RC_6H_4CH{=}NC_6H_5R')_a$ wherein a is 1 or 2, R and R' are individually hydrogen, para-chlorine, para-bromine or para-$NO_2$; $TeX_4 \cdot 2$ tetramethylthiourea, wherein X is chlorine or bromine; $TeCl_4 \cdot SR_2$ wherein R is alkyl, such as alkyl containing 1 to 5 carbon atoms, e.g., methyl, ethyl, propyl and butyl, or aryl, such as phenyl; and $TeCl_4 \cdot 2(2,6\text{-lutidine-N-oxide})$.

Other useful tellurium (IV) compounds are tellurium (IV) coordination complexes with bidentate anionic ligands having group Va and VIa donor atoms, such as $Te(S_2CNR_2)_4$, wherein R is hydrogen, alkyl or aryl, as described. Examples of such compounds are described, for instance, in S. Husebye and S. E. Svaernen, Acta Chem. Scand., 29A, 185 (1975); $Te(O_2C_4H_6)_2$ described in P. J. Antikainen and P. J. Malkonen, Z.anorg.u.allgem. Chem., 299, 292 (1959).

Further useful tellurium oxidizing agents in imaging elements according to the invention include such tellurium (II) and (IV) derivatives as TeRR' and RTeTeR wherein R and R' are individually alkyl, aryl or acyl, as described; $TeR_nX_{4-n}$, wherein R is alkyl, aryl or acyl, as described, and X is Cl, Br, I, SCN, SeCN, CNO, $N_3$, $BH_3CN$, $O_2CR$ and the like, and n is 1 to 4.

Other useful organotellurium (II) and (IV) compounds are included, for instance, in K. J. Irgolic, *The Organic Chemistry of Tellurium,* Gordon and Breach Science Publishers, N.Y., N.Y., 1974 and K. J. Irgolic, J. Organometal. Chem., 103, 91 (1975).

The selection of an optimum organotellurium compound, as described, in an imaging element according to the invention will depend upon such factors as the particular reducing agent in the imaging material, processing conditions, desired image, and the like.

An especially useful tellurium (II) oxidizing agent is the coordination complex $Te[S_2CN(C_2H_5)_2]_2$. An especially useful tellurium (IV) oxidizing agent is $TeBr_2(CH_2C_6H_5)_2$.

If desired, the described organotellurium (II) and (IV) compounds can be prepared in situ in the heat-developable photographic materials according to the invention. However, due to the better control achieved by preparation of the organotellurium compound separate from other components of the described heat-developable materials, it is usually desirable to prepare the organotellurium (II) and (IV) compounds ex situ, that is, separate from other components of the described compositions. The organotellurium compounds then can be mixed with other components of the heat-developable photographic materials as desired.

The described heat-developable photographic materials according to the invention include a photographic metal compound. This photographic metal compound can be any photosensitive metal salt or complex which provides the desired developable nuclei upon image-wise exposure. However, an especially useful photographic metal compound comprises photographic silver halide due to its high degree of photosensitivity. A typical concentration of photographic metal compound is from about 0.0001 to about 10.0 moles of photographic metal compound per mole of oxidizing agent in the oxidation-reduction image-forming combination. For example, a typically useful concentration range of photographic silver halide comprises about 0.001 to about 2.0 moles per mole of described tellurium complex. While photographic silver halide is typically most useful because of its high degree of photosensitivity, other photographic materials are also useful. For example, useful photosensitive silver materials include silver dye complexes such as those described in U.S. Pat. No. 3,647,439 of Bass issued Mar. 7, 1972. Preferred photographic silver halides are silver chloride, silver bromide, silver bromoiodide, silver chlorobromoiodide or mixtures thereof. For purposes of the invention, silver iodide is also considered to be a useful photographic silver halide. Very fine grain photographic silver halide is especially useful although coarse or fine grain photographic silver halide can be employed if desired. The photographic silver halide can be prepared by any of the procedures known in the photographic art. Such procedures and forms of photographic silver halide are described, for example, in the *Product Licensing Index,* Volume 92, December 1971, publication 9232 on page 107, paragraph I. The photographic silver halide as described can be unwashed or washed, can be chemically sensitized using chemical sensitization procedures known in the art, can be protected against the production of fog and stabilized against loss of sensitivity during keeping as described in the above *Product Licensing Index* publication.

Due to the amplification effects observed as a result of the presence of the oxidation-reduction image-forming combination, the concentration of photographic metal compound can be lower than normally would be found useful. This lower concentration is enabled by the amplification effect of the oxidation-reduction image-forming combination as described. In some instances the concentration of photographic metal compound can be lower than would be visibly observable after image-wise exposure and development of the photographic metal compound above.

The heat-developable materials according to the invention can also comprise one or more other oxidizing agents than the described organotellurium (II) and (IV) oxidizing agent if desired. For example, the heat-developable materials according to the invention can contain a silver salt oxidizing agent such as a silver salt of a long-chain fatty acid. Such silver salt oxidizing agents are typically resistant to darkening upon illumination. Typically useful silver salts of long-chain fatty acids are those containing about 17 to 30 carbon atoms. Compounds which are useful silver salt oxidizing agents include, for example: silver behenate, silver stearate, silver oleate, silver laurate, silver hydroxystearate, silver caprate, silver myristate and silver palmitate. Silver salts which are not silver salts of long-chain fatty acids can be useful in combination with the described tellurium complexes also. Such silver salt oxidizing agents include, for example, silver benzotriazole, silver benzoate, silver terephthalate, silver complexes and the like. Examples of other heavy metal salt oxidizing agents are gold stearate, mercury behenate and gold behenate. Combinations of the described oxidizing agents can also be useful.

The described heat-developable elements and compositions can comprise a variety of reducing agents. These reducing agents can be organic reducing agents or inorganic reducing agents or combinations with organic reducing agents being preferred. Reducing agents which are especially useful are typically silver halide developing agents. Examples of useful reducing agents include phenolic reducing agents, such as polyhydroxybenzenes, including, for instance, hydroquinone, alkyl-substituted hydroquinones, including tertiary butyl hydroquinone, methyl hydroquinone, 2,5-dimethylhydroquinone and 2,6-dimethylhydroquinone; catechols and pyrogallols; chloro-substituted hydroquinones such as chlorohydroquinone or dichlorohydroquinone; alkoxy-substituted hydroquinones, such as methoxyhydroquinone or ethoxyhydroquinone; aminophenol reducing agents such as 2,4-diaminophenols and methylaminophenols; ascorbic acid reducing agents such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; reductone reducing agents, such as 2-hydroxy-5-methyl-3-piperidino-2-cyclopentenone; sulfonamidophenol reducing agents such as the sulfonamidophenol reducing agents described in *Research Disclosure,* January 1973, pages 16–21; and the like. Combinations of reducing agents can be employed if desired. Selection of an optimum reducing agent or reducing agent combination will depend upon such factors as processing conditions, desired image, other components of the imaging material and the like.

A range of concentration of reducing agent is useful in the described heat-developable materials according to the invention. The optimum concentration will depend upon such factors as the particular photographic composition, processing conditions, desired image, and the like. Typically a concentration of about 0.1 to about 100 moles of reducing agent per mole of described oxidizing agent is employed in the heat-developable material according to the invention, preferably a concentration within the range of 0.5 to about 10 moles of reducing agent per mole of described oxidizing agent. A typical concentration of described reducing agent is, in a heat developable image element, about 0.1 to about 1000 mg/ft$^2$ of support which corresponds to 0.01 to 100 mg/dm$^2$. An especially useful concentration of described reducing agent is in a heat developable imaging element, about 1 to 500 mg/ft$^2$ which corresponds to 0.1 to 50 mg/dm$^2$.

A useful embodiment of the invention comprises a heat-developable, photographic element or composition comprising in reactive association (a) a photograhic metal compound, typically photographic silver halide, (b) an oxidation-reduction image-forming combination comprising: (i) a tellurium (II) or (IV) compound as an oxidizing agent, typically an organotellurium compound which is a coordination complex of tellurium (II) with two univalent bidentate sulfur-containing ligands, and (ii) a reducing agent which is an organic reducing agent selected from the group consisting of sulfonamidophenol, ascorbic acid, 3-pyrazolidone, hydroquinone reductone and aminophenol reducing agents and combinations thereof, and (c) a polymeric binder. Useful inorganic reducing agents include, for example, those described in U.S. Pat. No. 3,598,587 of Yudelson et al., issued Aug. 10, 1971.

It is desirable, in some cases, to employ a stabilizer or a stabilizer precursor in the described heat-developable materials according to the invention to improve post-processing image stability. In some cases the tellurium complexes themselves are stable after processing. However, in the case of photographic silver halide materials it can be desired to stabilize the photographic silver halide after processing in order to avoid post-processing printout. A variety of stabilizer or stabilizer precursors can be useful in the heat-developable photographic materials as described. These stabilizers or stabilizer precursors can be used alone or in combination. Typical useful stabilizers or stabilizer precursors include photolytically-activated polybrominated organic compounds, such as described in U.S. Pat. No. 3,874,946 of Costa et al., issued Apr. 1, 1975 and block stabilizer precursors, such as described in Belgian Pat. No. 768,071 issued July 30, 1971 and 4-aryl-1-carbamyl-2-tetrazoline-5-thione stabilizer precursors such as described in U.S. Pat. No. 3,893,859 of Burness et al., issued July 8, 1975.

A range of concentration of stabilizer or stabilizer precursor can be useful in the described heat-developable materials. An optimum concentration of stabilizer or stabilizer precursor will depend upon such factors as the particular heat-developable composition, processing conditions, desired stability of image, particular photographic components, and the like. A typical useful concentration range of stabilizer or stabilizer precursor is about 0.001 to about 100 moles of stabilizer or stabilizer precursor per mole of photographic silver compound in the heat-developable material, preferably a concentration within the range of about 0.01 to about 10 moles of stabilizer or stabilizer precursor per mole of photographic component.

The heat-developable materials according to the invention can contain various colloids and polymers alone or in combination as vehicles, binding agents, and in various layers. Suitable materials can be hydrophobic or hydrophilic. They are transparent or translucent and include both naturally occurring substances such as proteins, for example, gelatin, gelatin derivatives, cellulose derivatives, polysaccharides, such as dextran, gum arabic and the like; and synthetic polymeric substances such as water-soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include water-insoluble polymers of alkyl acrylates and methacrylates, acrylic acid, sulfoalkyl acrylates, methacrylates, and those which have cross-linking sites which facilitate hardening or curing. Especially useful materials are high molecular weight materials and resins which are compatible with the described tellurium complexes, including poly(vinyl butyral), cellulose acetate butyrate, poly(methyl methacrylate), poly(vinyl pyrrolidone), ethylcellulose, polystyrene, poly(vinyl chloride), polyisobutylene, butadiene-styrene copolymers, vinyl chloride-vinyl acetate copolymers, copolymers of vinyl acetate, vinyl chloride and maleic acid, and poly(vinyl alcohol). Combinations of the described colloids and polymers can also be used.

It is in some cases useful to employ a so-called overcoat layer on the heat-developable elements according to the invention to reduce fingerprinting and abrasion marks. The overcoat layer can be one or more of the described polymers which are also useful as binders or other polymeric materials which are compatible with the heat-developable layer and can tolerate the processing temperatures employed according to the invention.

The heat-developable materials according to the invention can contain development modifiers that function as speed-increasing compounds, hardeners, antistatic layers, plasticizers and lubricants, coating aids, brighteners, spectral sensitizing dyes, absorbing and filter dyes, also as described in the *Product Licensing Index,* Vol. 92, December 1971, publication 9232, pages 107–110.

The heat-developable elements according to the invention can comprise a variety of supports which can tolerate the processing temperatures employed according to the invention. Typical supports include cellulose ester film, poly(vinyl acetal) film, poly(ethylene terephthalate) film, polycarbonate film and polyester film supports as described in U.S. Pat. No. 3,634,089 of Hamb, issued Jan. 11, 1972 and U.S. Pat. No. 3,725,070 of Hamb et al., issued Apr. 3, 1973 and related films and resinous materials, as well as glass, paper, metal and the like supports which can withstand the processing temperatures employed according to the invention. Typically a flexible support is employed.

The compositions according to the invention can be coated on a suitable support by various coating procedures known in the photographic art including dip coating, air-knife coating, curtain coating or extrusion coating using hoppers such as described in U.S. Pat. No. 2,681,294 of Beguin, issued June 15, 1954. If desired, two or more layers can be coated simultaneously such as described in U.S. Pat. No. 2,761,791 of Russell, issued Sept. 4, 1956 and British Pat. No. 837,095.

Spectral sensitizing dyes can be useful in the described elements and compositions of the invention to confer additional sensitivity to the elements and compositions. Useful sensitizing dyes are described, for example, in the *Product Licensing Index,* Vol. 92, December 1971, publication 9232, pages 107–110, paragraph XV.

The described components of the heat-developable materials according to the invention can be in any suitable location in the heat-developable element according to the invention which provides the desired image. If desired, one or more of the components of the heat-developable element according to the invention can be in one or more layers of the element, preferably contiguous layers. For example, in some cases, it can be desirable to include certain percentages of the described reducing agents, image stabilizer or stabilizer precursors and/or other addenda in a protective layer over the heat-developable element. In some cases this can reduce migration of certain addenda between layers of the described element.

It is believed that the nuclei formed in the element upon imagewise exposure increase the reaction rate and act as catalysts for the image-forming combination containing the tellurium complex and reducing agent in the heat-developable material according to the invention. It is believed that enables a lower processing temperature for amplification of the nuclei image than otherwise would be possible.

The term "in reactive association" is intended to mean that the nuclei resulting from imagewise exposure are in a location with respect to the other described components, especially the oxidation-reduction image-forming combination, of the material according to the invention which enable this desired lower processing temperature and provides a more useful developed image.

If desired, other heat-developable photographic materials can be used in combination with the heat-developable photographic materials according to the invention containing tellurium complexes. For example, a heat-developable photographic element can comprise, respectively, a support having thereon a heat-developable photographic layer comprising a tellurium complex according to the invention and a separate layer containing a photothermographic material containing photographic silver halide as a component with other necessary imaging materials. An example of such a heat-developable photographic material is one containing a heat-developable layer (I) contiguous to the organotellurium compound containing heat-developable layer (II), wherein layer (I) contains photographic silver halide in association with a silver salt of certain heterocyclic thione compounds and an organic reducing agent such as described in U.S. Pat. No. 3,983,860 of Sutton et al., issued July 8, 1975.

While a variety of organotellurium (II) and (IV) compounds and photographic metal salts are useful in heat-developable elements and compositions according to the invention, an especially useful heat-developable material is a heat-developable photographic element comprising a support having thereon in reactive association (a) photographic silver halide, (b) an oxidation-reduction image-forming combination comprising: (i) a tellurium bis(diethyl dithiocarbamate) oxidizing agent, and (ii) a pyrazolidone reducing agent, as described, and (c) a polymeric binder.

Another especially useful heat-developable material according to the invention is a heat-developable, photographic element comprising a support having thereon in reactive association (a) photographic silver halide, (b) an oxidation-reduction image-forming combination comprising: (i) a tellurium di(isopropyl xanthate) oxidizing agent, and (ii) a pyrazolidone reducing agent, as described, and (c) a polymeric binder.

A further especially useful heat-developable material according to the invention is a heat-developable, photographic element comprising a support having thereon in reactive association (a) photographic silver halide, (b) an oxidation-reduction image-forming combination comprising: (i) a dibenzyl tellurium dibromide oxidizing agent and (ii) a phenolic reducing agent, as described, and (c) a polymeric binder.

Various imagewise exposure means are useful with the photosensitive material according to the invention. The materials according to the invention are typically sensitive to the ultraviolet and blue regions of the spectrum and exposure means which provide this radiation are preferred. Typically a photosensitive element according to the invention is exposed imagewise with a visible light source such as a tungsten lamp, although other sources of radiation are useful such as lasers, electron beams and the like.

A visible image can be developed in a heat-developable material as described after imagewise exposure within a short time merely by overall heating of the heat-developable material. An image having a maximum reflection density of at least 1.0 and typically at least 1.5 can be provided according to the invention. For example, the heat-developable element can be heated to a temperature within the range of about 80° C. to about 220° C. until a desired image is developed, typically within about 1 to about 90 seconds. The heat-developable material according to the invention is preferably heated to a temperature within the range of about 100° to about 170° C. until the desired image is developed, such as within about 2 to about 60 seconds.

Another embodiment of the invention is a process of developing an image in an exposed, heat-developable photographic element, as described, comprising heating the element to within the range of about 80° C. to about 220° C. until a desired image is developed.

For example, an embodiment according to the invention is a process of developing an image in an exposed, heat-developable photographic element comprising in support having thereon in reactive association: (a) a photographic metal compound selected from the group consisting of photographic salts of copper, palladium and silver and combinations of such salts, (b) an oxidation-reduction image-forming combination comprising (i) an organotellurium (II) or (IV) compound as an oxidizing agent, as described, and (ii) an organic reducing agent, also as described, and (c) a polymeric binder; comprising heating the element to a temperature within the range of about 80° C. to about 220° C. until a desired image is developed, such as for about 1 to about 30 seconds.

An especially useful embodiment of the invention is a process of developing an image in an exposed, heat-developable photographic element comprising a support having thereon in reactive association (a) photographic silver halide, (b) an oxidation-reduction image-forming combination comprising (i) a tellurium bis(-diethyl dithiocarbamate) oxidizing agent, a tellurium di(isopropyl xanthate) oxidizing agent or a dibenzyl tellurium dibromide oxidizing agent, and (ii) a reducing agent, as described, and (c) a polymeric binder, comprising heating the element to within the range of about 100° C. to about 170° C. for about 1 to about 10 seconds.

The heat-developable materials according to the invention are useful for forming a negative or positive image. The formation of a negative or a positive image will depend primarily upon the selection of the reducing agent for the oxidation-reduction image-forming combination. A reducing agent which is useful for providing a positive image includes, for example, tert.-butylhydroquinone.

While photographic silver halide is preferred for producing physically developable metal nuclei according to the invention because of its high degree of photosensitivity, other photographic metal compounds that provide physically developable metal nuclei are useful for forming images according to the invention. Other photographic metal compounds that provide physically developable nuclei which are useful include photographic chromium, iron, cobalt, nickel, copper, cadmium, selenium, palladium, silver, tin, tellurium, iridium, ruthenium, rhenium, platinum, rhodium and gold and lead compounds and combinations of these compounds.

Especially useful photographic metal compounds are selected from the group consisting of photographic silver, tellurium, palladium, copper and gold compounds. Examples of such compounds include: $Te(S_2P(OCH_3)_2)_2$; $K_2Pd(C_2O_4)_2$; $Pd(P(C_6H_5)_3)_2(C_2O_4)$; $[Cu(P(OCH_3)_3)_4]B(C_6H_5)_4$; $[Cu(P(OCH_3)_3)BH_3CN]_2$; $Cu(Sb(C_6H_5)_3)_3Cl$; and $[Cu(ethylenediamine)_2][B(C_6H_5)_4]_2$. Other photosensitive Pd complexes are described in U.S. Pat. No. 3,719,490 (Yudelson and Gysling issued March 6, 1973) and *Research Disclosure* 13705 (September 1975, B. F. Nellis). Other useful Cu complexes are described in U.S. Pat. No. 3,859,092 of Gysling and Vinal issued Jan. 7, 1975; U.S. Pat. No. 3,860,500; U.S. Pat. No. 3,860,501; U.S. Pat. No. 3,927,055; and U.S. Pat. No. 3,880,724 of Gysling.

Development can also be effected using a diffusion transfer process. In one embodiment of such a process, a photosensitive element comprising a photographic metal salt, for example, a photographic salt of silver, palladium, tellurium or copper, is exposed in the usual manner and is then contacted with a receiving sheet comprising a tellurium (II) or (IV) compound and a reducing agent according to the invention. When the element and receiving sheet are in contact, heat is applied to promote diffusion of unexposed photographic metal salt from the element to the receiving sheet. Contact temperatures of from 45° C. to 200° C. are suitable. In the unexposed areas of the element, the metal salt migrates from the element to the receiving sheet where it is reduced and catalyzes the reduction of the tellurium complex to tellurium metal by the reducing agent in the sheet to form a positive image on the receiving sheet.

In another embodiment of a diffusion transfer process, the photosensitive element comprises at least one photosensitive layer having permanently associated therewith a receiving layer. The photosensitive layer comprises a photographic metal salt as exemplified hereinabove and the receiving layer comprises a tellurium (II) or (IV) compound and a reducing agent according to the invention. The element is exposed in the usual manner and is then heated at about 75° C. to 250° C. to promote diffusion of unexposed photographic metal salt to the receiving layer. In the unexposed areas of the photosensitive layer, the metal salt diffuses from the layer to the receiving layer where it is reduced and acts as a catalyst, as set forth above, to form a positive image on the receiving layer.

The class of organotellurium compounds that includes diorganoditellurides as oxidizing agents, as described, can be prepared by synthetic routes such as (1) reduction of an aryltellurium trichloride, (2) reaction of tellurium metal with an aryl lithium reagent, followed by aerial hydrolysis of the so formed LiTe aryl or (3) reaction of tellurium metal with a Grignard reagent, followed by aerial hydrolysis of the so formed MgX(Te) aryl. Other specialized methods of preparing these diorganoditellurides are also known in the art. Examples of diarylditellurides are represented by $Ar_2Te_2$ wherein Ar is $C_6H_5$, p-$CH_3OC_6H_4$, p-$CH_3C_6H_4$, p-$BrC_6H_4$ and 1-naphthyl.

A method for preparing $TeR_2X_2$ is represented by the reaction:

$$TeCl_4 + RHgX \longrightarrow TeCl_2R_2 \xrightarrow[\text{metathesis}]{NaBr} TeBr_2Br_2$$

These organotellurium (II) and (IV) compounds are also useful oxidants as described.

The following examples are included for a further understanding of the invention.

EXAMPLE 1 - Use of Silver Compound

A heat-developable photographic element was prepared by coating the following solution on a resin-coated paper support at a wet coating thickness of 9 mils:

(A) 40 mg of tellurium di(methyl xanthate) was dissolved in 10 ml of a 2% by weight acetone-toluene (1:1 parts by volume) solution of poly(vinyl butyral), (B) 2 ml of a 10% by weight solution of 4-hydroxymethyl-4-methyl-1-phenyl-3-pyrazolidone in acetone-toluene-dimethylformamide (45:45:10 parts by volume) was added to the resulting composition (A), and (C) 2 ml of a photographic silver bromoiodide poly(vinyl butyral) emulsion in an acetone solution of poly(vinyl butyral).

The resulting coating contained 8 mg of silver/$ft^2$ and 33 mg of tellurium/$ft^2$.

The resulting heat-developable photographic material was dried at about 43° C.

A sample of this sensitized paper was imagewise exposed for 60 seconds through an exposure means to provide a heat-developable image. The resulting exposed element was then heated by contacting the element with a heated metal block at 140° C. for 8 seconds. A negative tellurium image resulted.

EXAMPLE 2 - Positive-working Mode

A sensitized paper was prepared by mixing the following solutions:

(A) 40 mg of $Te(S_2COCH_3)_2$dissolved in 10 ml of a 2% by weight acetone-toluene (1:1 parts by volume) solution of poly(vinyl butyral);

(B) 1 ml of a 10% by weight solution of tertiary butylhydroquinone in acetone-toluene (1:1 parts by volume); and (C) 2 ml of a silver bromoiodide poly(vinyl butyral) emulsion as described in Example 1.

The resulting composition was then coated at a wet thickness of 9 mils on a resin-coated paper support and dried at 43° C.

The sensitized paper was imagewise exposed for 60 seconds through a testing means using an exposure device to provide a heat-developable latent image. The exposed paper was then heated by contacting it with a metal block at 165° C. for 5 seconds. A positive tellurium image of the original resulted.

EXAMPLE 3 - Use of Pd Compound

An imaging element was prepared by dissolving 100 mg of $Te(p—CH_3OC_6H_4)_2$, 25 mg of dimethylamine borane and 70 mg $[Pd(Et_4\ dien)Cl]B(C_6H_5)_4$ in 10 ml of a 4% $CHCl_3$ solution of poly(vinyl acetal) (Formvar which is a trade name of Monsanto Chemical Co., U.S.A.) and coating the resulting solution at an 8 mil wet coating thickness on a poly(ethylene terephthalate) film support. The coating was permitted to dry and then was imagewise exposed to a visible light source for 5 minutes to provide a developable image in the element. The element was then heated by contacting it with a heated metal block at 150° C. for 20 seconds. A grey colored, positive tellurium image was produced.

EXAMPLE 4 - Use of Photosensitive Copper Complex

A photosensitive element (A) was prepared by coating at a 9 mil wet coating thickness on a poly(ethylene terephthalate) film support: 200 mg of the copper complex $[Cu(P(OCH_3)_3)_4]B\phi_4$ wherein $\phi$ represents phenyl (described in U.S. Pat. No. 3,860,501) and 200 mg of 1-phenyl-3-pyrazolidone (reducing agent) in 10 ml of 4% by weight $CHCl_3$ solution of poly(vinyl acetal) (Formvar 15/95E which is a trade name of the Monsanto Chemical Co., U.S.A.). A separate element (B) was prepared by dissolving 100 mg of $TeCl_2[CH_2C(O)o—CH_3O—C_6H_4]_2$ and 100 mg of t-butylhydroquinone in 10 ml of a 2% acetone solution of poly(vinyl butyral (Butvar B-76, a trade name of the Monsanto Chemical Co., U.S.A.) and coating the resulting composition at a 9 mil wet coating thickness on a poly(ethylene terephthalate) film support. Element A was imagewise exposed to a high intensity light source to provide a developable latent image in the element. Elements A and B were then laminated together and heated by passing the resulting so-called sandwich between heated rollers at 155° C. for 10 seconds. A developed image was produced in the sandwich.

Useful results can be obtained with a dibenzyl tellurium dibromide oxidizing agent, as described.

Useful results can also be provided individually with $C_6H_5TeTeC_6H_5$, $(p—CH_3C_6H_4)_2Te_2$, $(p—CH_3OC_6H_4)_2Te_2$, $(p—BrC_6H_4)_2Te_2$, and $(1\text{-naphthyl})_2Te_2$ as the described oxidizing agent.

Another useful organotellurium (II) oxidizing agent is $Te(p—CH_3O—C_6H_4)_2$ and other useful organotellurium (IV) oxidizing agents are $Te(p—CH_3O—C_6H_4)_2Cl_2$ and $TeCl_2(CH_2C(O)p—CH_3O—C_6H_4)_2$.

The invention has been described in detail with particular reference to preferred embodiments thereof, but it will be understood that variations and modifications can be effected within the spirit and scope of the invention.

What is claimed is:

1. In a heat developable, photographic element comprising a support having thereon in reactive association a. a photographic metal compound, b. an oxidation-reduction image-forming combination comprising:

i. a non-silver metal compound as an oxidizing agent, and ii. a reducing agent, and c. a binder, the improvement wherein said non-silver metal compound as an oxidizing agent consists essentially of an organotellurium (II) or (IV) compound.

2. A heat developable, photographic element as in claim 1 wherein said photographic metal compound is selected from the group consisting of photographic compounds of copper, tellurium, palladium, gold and silver and combinations of such compounds.

3. A heat developable, photographic element as in claim 1 wherein said photographic metal compound is photographic silver halide.

4. A heat developable, photographic element as in claim 1 wherein said tellurium compound is a coordination complex of tellurium (II) or (IV).

5. A heat developable, photographic element as in claim 1 wherein said tellurium compound is a coordination complex of tellurium (II) with two univalent bidentate sulfur-containing ligands.

6. A heat developable, photographic element as in claim 1 wherein said tellurium compound is selected from the group consisting of $Te(S_2COCH_3)_2$,
$Te(S_2COC_2H_5)_2$,
$Te[S_2P(C_6H_{11})_2]_2$,
$Te(S_2COC_{10}H_{21})_2$,
$Te[S_2P(OC_6H_5)_2]_2$,
$Te[S_2P(OC_2H_5)_2]_2$,
$Te[S_2CN(C_2H_5)_2]_2$,
$Te[S_2CN(CH_2C_6H_5)_2]_2$,
$Te(p\text{-}CH_3O\text{-}C_6H_4)_2$,
$C_6H_5TeTeC_6H_5$,
$Te(p\text{-}CH_3O\text{-}C_6H_4)_3Cl$,
$Te(C_6H_4OCH_3)_2Cl_2$,
$TeCl_2(CH_2C(O)o\text{-}CH_3O\text{-}C_6H_4)_2$,
$TeBr_2(CH_2C_6H_5)_2$,
$Te(S_2COC_5H_{11})_2$, and
$Te[S_2COCH(CH_3)_2]_2$.

7. A heat developable, photographic element as in claim 1 wherein said non-silver metal compound as an oxidizing agent consists essentially of $Te[S_2CN(C_2H_5)_2]_2$ or $TeBr_2(CH_2C_6H_5)_2$.

8. A heat developable, photographic element as in claim 1 also comprising an image stabilizer precursor.

9. A heat developable, photographic element as in claim 1 also comprising a thione image stabilizer precursor.

10. A heat developable, photographic element as in claim 1 wherein said reducing agent is an organic reducing agent selected from the group consisting of sulfonamidophenol, ascorbic acid, 3-pyrazolidone, hydroquinone, reductone and aminophenol reducing agents and combinations thereof.

11. A heat developable, photographic element as in claim 1 comprising for each mole of said photographic metal salt, 0.1 to 10,000 moles of said organotellurium (II) or (IV) compound, and 0.01 to $10^5$ moles of said reducing agent.

12. A process of developing an image in an exposed, heat developable, photographic element as defined in claim 1 comprising heating said element to within the range of about 80° C. to about 220° C.

13. A process of developing an image in an exposed, heat developable, photographic element as defined in claim 1 wherein said tellurium compound is a coordination complex of tellurium (II) with two univalent bidentate sulfur-containing ligands, comprising heating said element to within the range of about 80° C. to about 220° C.

14. In a heat developable, photographic composition comprising a. a photographic metal compound, b. an oxidation-reduction image-forming combination comprising:

i. a non-silver metal compound as an oxidizing agent, and ii. a reducing agent, and c. a binder, the improvement wherein said non-silver metal compound as an oxidizing agent is an organotellurium (II) or (IV) compound.

15. A heat developable, photographic composition as in claim 14 wherein said photographic metal compound is selected from the group consisting of photographic compounds of copper, palladium, gold and silver and combinations of said compounds.

16. A heat developable, photographic composition as in claim 14 wherein said photographic metal compound is photographic silver halide.

17. A heat developable, photographic composition as in claim 14 wherein said tellurium compound is a coordination complex of tellurium (II) or (IV).

18. A heat developable, photographic composition as in claim 14 wherein said tellurium compound is a coordination complex of tellurium (II) with two univalent bidentate sulfur-containing ligands.

19. A heat developable, photographic composition as in claim 14 wherein said tellurium compound is selected from the group consisting of $Te(S_2COCH_3)_2$,
$Te(S_2COC_2H_5)_2$,
$Te[S_2P(C_6H_{11})_2]_2$,
$Te(S_2COC_{10}H_{21})_2$,
$Te[S_2P(OC_6H_5)_2]_2$,
$Te[S_2P(OC_2H_5)_2]_2$,
$Te[S_2CN(C_2H_5)_2]_2$,
$Te[S_2CN(CH_2C_6H_5)_2]_2$,
$Te(p\text{-}CH_3O\text{-}C_6H_4)_2$,
$C_6H_5TeTeC_6H_5$,
$Te(p\text{-}CH_3O\text{-}C_6H_4)_3Cl$,
$Te(C_6H_4OCH_3)_2Cl_2$,
$TeCl_2(CH_2C(O)o\text{-}CH_3O\text{-}C_6H_4)_2$,
$TeBr_2(CH_2C_6H_5)_2$,
$Te(S_2COC_5H_{11})_2$, and
$Te[S_2COCH(CH_3)_2]_2$.

20. A heat developable, photographic composition as in claim 14 wherein said tellurium compound consists essentially of $Te[S_2CN(C_2H_5)_2]_2$ or $TeBr_2(CH_2C_6H_5)_2$.

21. A heat developable, photographic composition as in claim 14 also comprising an image stabilizer precursor.

22. A heat developable, photographic composition as in claim 14 also comprising a thione image stabilizer precursor.

23. A heat developable, photographic composition as in claim 14 wherein said reducing agent is an organic reducing agent selected from the group consisting of sulfonamidophenol, ascorbic acid, 3-pyrazolidone, hydroquinone, reductone and aminophenol reducing agents and combinations thereof.

24. A heat developable, photographic composition as in claim 14 comprising for each mole of said photographic metal compound, 0.1 to $10^3$ moles of said tellurium compound, and 0.01 to $10^5$ moles of said reducing agent.

25. A heat developable, photographic element comprising a support having thereon in reactive association a. photographic silver halide, b. an oxidation-reduction image-forming combination comprising:

i. a tellurium bis(diethyl dithiocarbamate) oxidizing agent, and ii. a pyrazolidone reducing agent, and c. a polymeric binder.

26. A heat developable, photographic element comprising a support having thereon in reactive association a. photographic silver halide, b. an oxidation-reduction image-forming combination comprising i. a tellurium di(isopropyl xanthate) oxidizing agent, and ii. a pyrazolidone reducing agent, and c. a polymeric binder.

27. A heat developable, photographic composition comprising a. photographic silver halide, b. an oxidation-reduction image-forming combination comprising:

i. a tellurium bis(diethyl dithiocarbamate) oxidizing agent, and ii. a pyrazolidone reducing agent, and c. a polymeric binder.

28. A heat developable, photographic composition comprising a. photographic silver halide, b. an oxidation-reduction image-forming combination comprising:

i. a tellurium di(isopropyl xanthate) oxidizing agent, and ii. a pyrazolidone reducing agent, and c. a polymeric binder.

29. A process of developing an image in an exposed, heat developable, photographic element comprising a support having thereon, in reactive association, a. a photographic metal compound selected from the group consisting of photographic compounds of copper, tellurium, palladium and silver and combinations of such compounds, b. an oxidation-reduction image-forming combination comprising i. an organotellurium compound as an oxidizing agent and which is selected from the group consisting of $Te(S_2COCH_3)_2$,
$Te(S_2COC_2H_5)_2$,
$Te[S_2P(C_6H_{11})_2]_2$,
$Te(S_2COC_{10}H_{21})_2$,
$Te[S_2P(OC_6H_5)_2]_2$,
$Te[S_2P(OC_2H_5)_2]_2$,
$Te[S_2CN(C_2H_5)_2]_2$,
$Te[S_2CN(CH_2C_6H_5)_2]_2$,
$Te(p\text{-}CH_3O\text{-}C_6H_4)_2$,
$C_6H_5TeTeC_6H_5$,
$Te(p\text{-}CH_3O\text{-}C_6H_4)_3Cl$,
$Te(C_6H_4OCH_3)_2Cl_2$,
$TeCl_2(CH_2C(O)o\text{-}CH_3O\text{-}C_6H_4)_2$,
$TeBr_2(CH_2C_6H_5)_2$,
$Te(S_2COC_5H_{11})_2$, and $Te[S_2COCH(CH_3)_2]_2$.

ii. an organic reducing agent, and c. a polymeric binder, comprising heating said element to within the range of about 80° C. to about 220° C. for about 1 to about 30 seconds.

30. A process of developing an image in an exposed, heat developable, photographic element comprising a support having thereon in reactive association a. photographic silver halide, b. an oxidation-reduction image-forming combination comprising i. a tellurium bis(diethyl dithiocarbamate) oxidizing agent, and ii. a pyrazolidone reducing agent, and c. a polymeric binder, comprising heating said element to within the range of about 100° C. to about 170° C. for about 1 to about 10 seconds.

31. A process of developing an image in an exposed, heat developable, photographic element comprising a support having thereon in reactive association a. photographic silver halide, b. an oxidation-reduction image-forming combination comprising i. a tellurium di(isopropyl xanthate) oxidizing agent, and ii. a pyrazolidone reducing agent, and c. a polymeric binder, comprising heating said element to within the range of about 100° C. to about 170° C. for about 1 to about 10 seconds.

* * * * *

UNITED STATES PATENT AND TRADEMARK OFFICE

CERTIFICATE OF CORRECTION

PATENT NO. : 4,144,062

DATED : March 13, 1979

INVENTOR(S) : Mark Lelental and Henry J. Gysling

It is certified that error appears in the above-identified patent and that said Letters Patent are hereby corrected as shown below:

In the abstract, line 7, "photograhic" should read ---photographic---.

Column 3, line 10, "invention is" should read ---invention as---.

Column 6, line 39, "Agnew." should read ---Angew.---.

Column 9, line 51, "block" should read ---blocked---.

Column 15, line 39, a ")" should be inserted after "butyral".

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*